US005893013A

United States Patent [19]

Kinoshita et al.

[11] Patent Number: 5,893,013

[45] Date of Patent: Apr. 6, 1999

[54] DEVELOPER REGULATING MEMBER AND DEVELOPING APPARATUS

[75] Inventors: Masahide Kinoshita, Shizuoka-ken; Kazuhisa Kemmochi, Mishima; Tetsuya Kobayashi, Numazu; Takashi Shibuya, Shizuoka-ken; Yoshiro Saito, Numazu; Arihiro Yamamoto, Tokyo; Yasunari Watanabe, Susono; Tsuyoshi Nakagawa, Tokyo, all of Japan

[73] Assignee: Canon Kabushiki Kaisha, Tokyo, Japan

[21] Appl. No.: 859,479

[22] Filed: May 20, 1997

[30] Foreign Application Priority Data

May 27, 1996 [JP] Japan ..... 8-131875

[51] Int. Cl.[6] ..... G03G 15/08

[52] U.S. Cl. ..... 399/284

[58] Field of Search ..... 399/222, 252, 399/264, 265, 267, 274, 279, 284, 285; 118/261

[56] References Cited

U.S. PATENT DOCUMENTS

| | | | |
|---|---|---|---|
| 5,086,728 | 2/1992 | Konoshita | 399/281 |
| 5,287,150 | 2/1994 | Kinoshita et al. | 399/281 |
| 5,311,264 | 5/1994 | Kinoshita | 399/281 |
| 5,342,717 | 8/1994 | Su et al. | 430/55 |
| 5,353,104 | 10/1994 | Kato et al. | 399/274 |
| 5,369,478 | 11/1994 | Kobayashi et al. | 399/236 |
| 5,587,776 | 12/1996 | Watanabe et al. | 399/284 |

FOREIGN PATENT DOCUMENTS

| | | |
|---|---|---|
| 54-043038 | 4/1979 | Japan . |
| 58-116559 | 7/1983 | Japan . |

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

A developer regulating member includes a thin plate having a spring property and a polyamide-containing rubber layer disposed on the thin plate. The polyamide-containing rubber layer contains a polyamide having the Shore D hardness between 25 and 65 both inclusive. A developing apparatus includes a developer container for containing a monocomponent developer of negative charging property, a developer carrying member provided in an opening portion of the developer container, for carrying the developer, and a regulating member for forming a nip together with the developer carrying member and regulating a thickness of a developer layer on the developer carrying member. A surface of the regulating member forming the nip is comprised of a polyamide-containing rubber layer containing a polyamide having the Shore D hardness between 25 and 65 both inclusive.

6 Claims, 3 Drawing Sheets

DEVELOPER REGULATING MEMBER AND DEVELOPING APPARATUS

BACKGROUND OF THE INVENTION

1. Field of the Invention

The present invention relates to a developing apparatus used in image forming apparatus such as copiers and printers, and to a developer regulating member for regulating a developer, used in the developing apparatus.

2. Related Background Art

In the image forming apparatus of the electrophotographic method) the developing apparatus visualizes an electrostatic latent image formed on an image carrying member, in the form of a toner image.

As one type of such developing apparatus, a variety of dry-type monocomponent developing apparatuses were proposed and are under practical use. It is, however, not easy to form a thin layer of toner as a monocomponent developer on a developer carrying member in either one of the developing apparatus.

An improvement is demanded in resolution, visibility, and the like of image nowadays, and it is essential to develop a method and apparatus for forming the thin layer of toner. Some measures were proposed as to such method and apparatus.

For example, as described in Japanese Laid-open Patent Application No. 54-43038, there is a developing apparatus in which a rubber or metal elastic blade is set in contact with a developing sleeve of the developer carrying member and in which the toner is regulated as being passed through the contact portion between the elastic blade and the developing sleeve, whereby the thin layer of toner is formed on the developing sleeve and friction in the contact portion causes sufficient triboelectricity on the toner.

For regulating non-magnetic toner by the above elastic blade, a separate toner supply member for supplying the toner onto the developing sleeve becomes necessary. The reason is that in the case of magnetic toner the toner can be supplied onto the developing sleeve by magnetism of a magnet in the developing sleeve, whereas in the case of the non-magnetic toner the toner cannot be supplied by magnetism.

Thus, the developing apparatus shown in FIG. 4 was proposed in Japanese Laid-open Patent Application No. 58-116559. In this conventional developing apparatus proposed, an elastic roller 27 of fur brush structure in contact with the developing sleeve 26 is disposed at an upstream position in the rotating direction of the developing sleeve 26 with respect to the elastic blade 25 in a developer container 24 containing the nonmagnetic toner 23 as a monocomponent developer, and the elastic roller 27 scrapes the residual toner 23 remaining on the developing sleeve 26 without being consumed for development and also supplies new toner 23 onto the developing sleeve 26.

The above-stated structure enabled the thin film of non-magnetic toner 23 to be formed well on the developing sleeve 26 and thus enabled an electrostatic latent image to be developed well on the image carrying member.

However, demands for a further improvement in quality of image and for a further reduction in consumption energy induced the need for use of toner with smaller particle sizes and with lower melting point. In repeating the developing operation with a such toner many times, the following problems arose.

(1) When a thin metal plate of SUS, phosphor bronze, or the like is used as the elastic blade, longitudinal contact is likely to become nonuniform because of its too high hardness, so that coating unevenness of toner tends to occur on the developing sleeve. Further, the too high hardness causes excessive force to be applied locally on the toner and poor releasability of surface causes the toner to be fused on the surface of elastic blade in contact with the developing sleeve after repetition of the developing operation. This results in coating unevenness of toner or stripes on the developing sleeve, thus in turn resulting in poor quality of image.

(2) If the elastic blade is a plate of conventional urethane rubber, silicone rubber, or the like used singly or one formed by bonding such rubber onto a metal thin plate in order to achieve stable contact throughout long-term operation, the problem of (1) will be avoided, but triboelectrification capability to the toner will become insufficient, making triboelectricity insufficient on the toner. This will result in fog as a problem of image, and in the worst case it raises the problem that the toner is scattered from the developing sleeve to contaminate the inside of image forming apparatus.

Thus, the elastic blade itself needs to be made of a material with high triboelectrification capability. A material having high electron accepting property is selected for toner of positive polarity, while a material having high electron donating property is selected for toner of negative polarity.

There were various proposals on use of materials in which a charge control material of high electron donating property was added in a base material of silicone rubber, urethane rubber, or the like, especially for the negative-polarity toner among the above, but they were not sufficient yet in terms of the triboelectricity given to the toner. They were not successful yet in preventing occurrence of a foggy image especially under high-humidity circumstances.

In order to prevent this occurrence of a foggy image, materials of further higher electron donating property are effective, and for example, polyamide resins such as nylon are used. Since the polyamide resins do not have elasticity, it is of course impossible to use them in a plate shape singly. It is conceivable that they may be used in the form of a coating on a thin metal plate as a supporting layer for regulating pressure or in the form of a plate of resin bonded thereto.

Employment of this structure was able to prevent the occurrence of a foggy image in the initial state of developing operation, but on the other hand it raised coating unevenness of toner on the developing sleeve in the initial state and occurrence of fusion of toner to the surface of elastic blade after repetition of the developing operation, as in the above case of using the metal thin plate singly. A cause of this is of course that excessive force is exerted on the toner passing the elastic blade because of the too high hardness of polyamide resin. For decreasing the hardness, the elastic blade was thus constructed in such structure that, for example, urethane rubber was bonded as an elastic layer onto a metal thin plate and that a thin coating of polyamide resin was formed as a charge giving layer on the surface of urethane rubber. This structure improved the stability of toner coating on the sleeve, as compared with the structure in which the polyamide resin was directly formed on the thin metal film, but after repetition of the developing operation under high-temperature circumstances, this structure also resulted in fusion of toner at a high-hardness portion, because the hardness of polyamide resin itself was high in the surface layer. Thus, this structure was not preferable.

Accordingly, properties desired for the elastic blade are the excellent charge giving property to the toner and possession of appropriate hardness to allow the toner to pass in an appropriate layer thickness through the contact portion without exerting the excessive force thereon in the contact portion. The above conventional materials and structures failed to meet these properties sufficiently and thus failed to prevent fog and fusion of toner.

It was proposed in Japanese Patent Application No. 7-155511 that the elastic blade was made of a polyamide elastomer containing a polyamide component of good triboelectrification capability to the negative toner and a polyether component having elasticity.

It was, however, found that simply using this material was not enough to prevent the fog and fusion of toner and it was necessary to further define a proper range of hardness of the polyamide elastomer in use in order to draw the full performance.

With too low hardnesses, the desired triboelectrification capability cannot be attained, so that the fog occurs especially under high-humidity circumstances. This is because low-hardness polyamide elastomers include low contents of the polyamide component in the formulation thereof and therefore the electron donating property of the elastic blade to the negative toner is too low.

Too high hardnesses will cause coating unevenness due to fusion of toner, because the excessive force is exerted on the toner passing the elastic blade, as being the case with the polyamide resin of the conventional example described above.

SUMMARY OF THE INVENTION

An object of the present invention is to provide a developer regulating member and a developing apparatus free from coating unevenness and occurrence of stripe.

Another object of the present invention is to provide a developer regulating member and a developing apparatus that can give high triboelectricity to the developer.

Still another object of the present invention is to provide a developer regulating member and a developing apparatus arranged to prevent fog and fusion of developer.

Still another object of the present invention is to provide a developer regulating member comprising a thin plate having a spring property, and a polyamide-containing rubber layer disposed on the thin plate, said layer containing a polyamide having the Shore D hardness between 25 and 65 both inclusive, and also to provide a developing apparatus comprising the foregoing developer regulating member.

Further objects of the present invention will become apparent in the description which follows.

DETAILED DESCRIPTION OF THE PREFERRED EMBODIMENTS

The embodiments of the present invention will be described.

(Embodiment 1)

Figure 1:
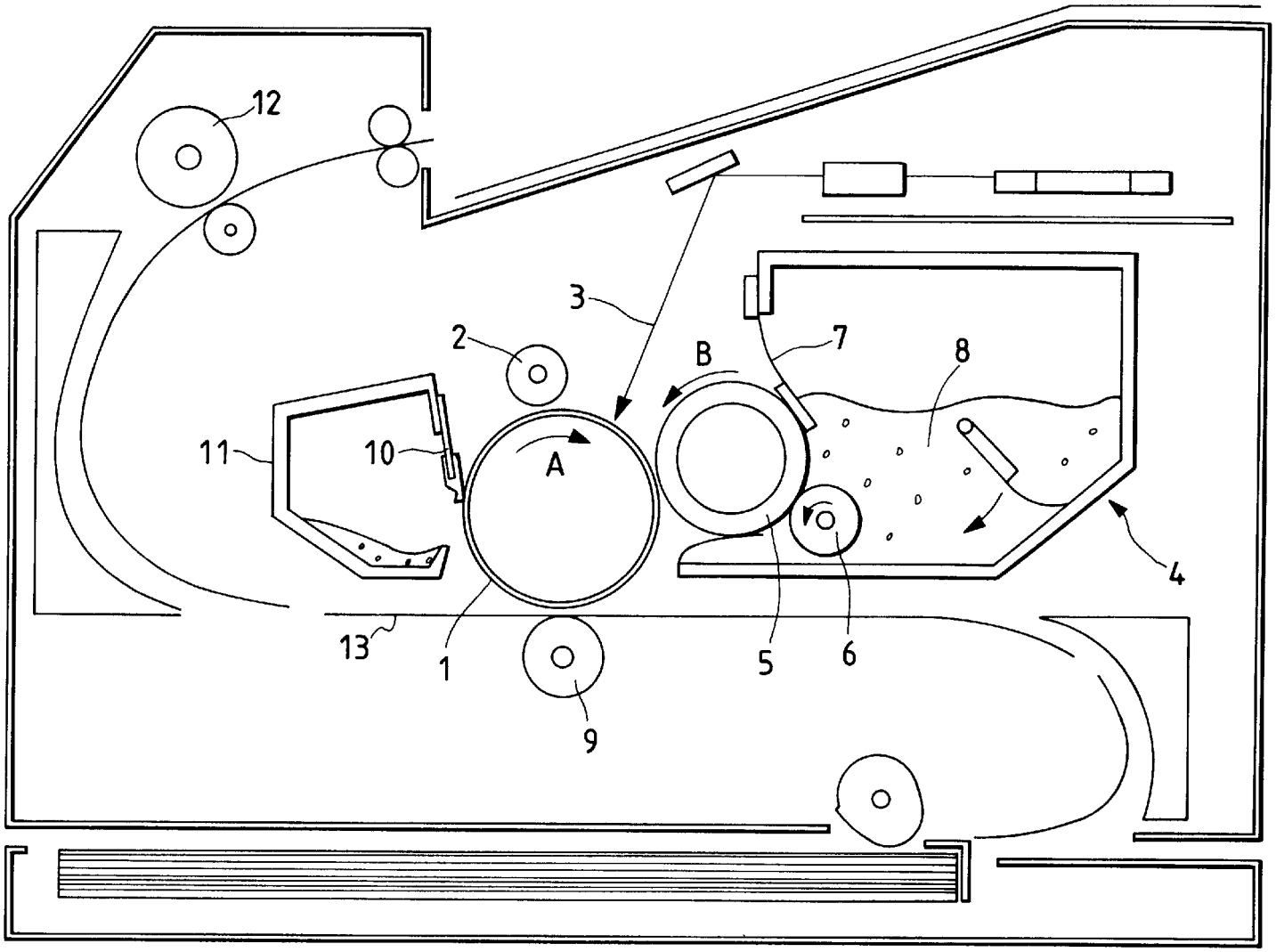
FIG. 1 is a schematic, cross-sectional view of an image forming apparatus using the developing apparatus of Embodiment 1 according to the present invention.
Figure 2:
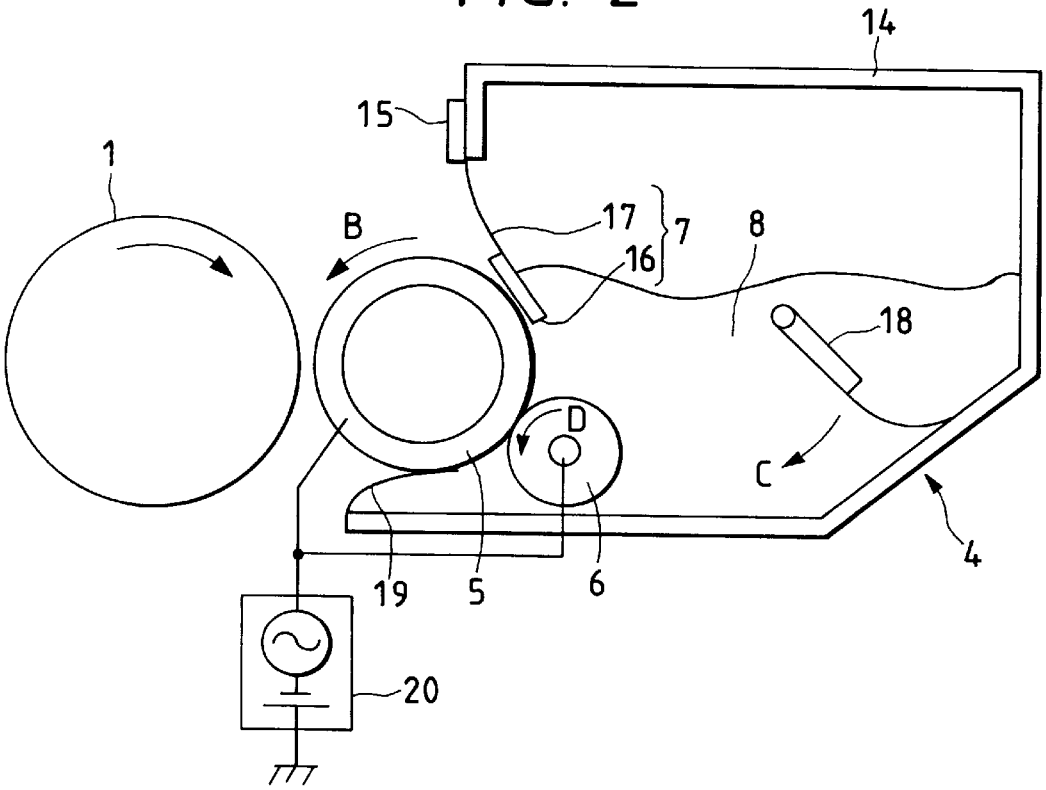
FIG. 2 is a schematic, cross-sectional view of the developing apparatus of Embodiment 1 according to the present invention.

FIG. 1 is a cross-sectional view of the image forming apparatus using the developing apparatus as an embodiment of the present invention and FIG. 2 is a cross-sectional view of the developing apparatus. In FIG. 1, a photosensitive drum 1 as a latent image carrying member rotates in the direction of arrow A, the photosensitive drum 1 is uniformly charged by a charging device 2 for charging it, and the photosensitive drum 1 is exposed to laser light 3 emitted from a laser optical device being exposure means for writing an electrostatic, latent image thereon, thereby forming the electrostatic, latent image on the surface thereof.

This electrostatic, latent image is developed by the developing apparatus 4 disposed in the vicinity of the photosensitive drum 1 and detachably mounted in the form of a process cartridge on the image forming apparatus, so as to be visualized as a toner image. (In the present embodiment so-called reversal development is carried out to form a toner image in the exposed portion.)

The toner image visualized on the photosensitive drum 1 is transferred to sheet 13 as a recording medium by a transfer roller 9, transfer-residue toner remaining on the photosensitive drum 1 without being transferred is scraped by a cleaning blade 10 to be stored in a waste toner container 11, and the thus cleaned photosensitive drum 1 repeats the above action to form images.

On the other hand, the sheet 13 with the transferred toner image is subjected to a fixing process by a fixing device 12 and the sheet is then discharged to the outside of apparatus, thus completing the print operation.

The developing apparatus 4 according to the present invention will be described in more detail referring to FIG. 2.

In FIG. 2, reference numeral 14 designates a developer container for containing non-magnetic toner 8 of negative charge property as a monocomponent developer, and the present developing apparatus 4 is arranged to have a developing sleeve 5 as a developer carrying member located at an opening portion extending in the longitudinal direction in the developer container 14 and opposed to the photosensitive drum 1 and to develop the electrostatic, latent image on the photosensitive drum 1 to visualize it.

In the above developing apparatus 4, the developing sleeve 5 laterally extends in the above opening portion so that the substantially right half peripheral surface as illustrated intrudes in the developer container 14 while the substantially left half peripheral surface is exposed to the outside of the developer container 14. The exposed surface to the outside of this developer container 14 is opposed with a very small gap to the photosensitive drum 1 located left of the developing apparatus 4. The developing sleeve 5 is driven to rotate in the direction of arrow B and the surface thereof has proper roughness for raising a rubbing probability against the toner 8 and for good conveyance of toner 8.

Above the developing sleeve 5 there is disposed an elastic blade 7 arranged to be supported by a stop plate 15 and to keep the vicinity of its tip on the free end side in surface contact with the outer peripheral surface of the developing sleeve 5. The contact direction is the so-called counter direction in which the tip side is located on the upstream side in the rotating direction of developing sleeve 5 with respect to the contact portion.

This elastic blade 7 is one obtained by bonding a polyamide-containing rubber (hereinafter referred to as polyamide elastomer) as an elastic member 16 onto a thin metal film 17 of SUS or phosphor bronze having spring elasticity or one obtaining by injection-molding the polyamide-containing rubber on the metal thin plate 17. This metal thin plate maintains the pressing force of elastic blade 7 against the developing sleeve 5 and the polyamide elastomer secures the charging property to the negative-polarity toner 8. The material, a preparing process, etc. of this elastic blade 7 will be detailed hereinafter.

An elastic roller 6 is in contact with the developing sleeve 5 on the upstream side in the rotating direction thereof with respect to the contact portion of the above elastic blade 7 with the surface of developing sleeve 5 and is supported rotatably.

In the present developing apparatus 4 described above, in the developing operation the toner 8 in the developer container 14 is fed toward the elastic roller 6 with rotation of agitating member 18 in the direction of arrow C.

Further, the toner 8 is carried to the vicinity of developing sleeve 5 with rotation of the elastic roller 6 in the direction of arrow D. In the contact portion between the developing sleeve 5 and the elastic roller 6, the toner 8 carried on the elastic roller 6 is rubbed by the developing sleeve 5 to be subject to triboelectrification, thereby coming to be deposited on the developing sleeve 5.

After that, with rotation of the developing sleeve 5 in the direction of arrow B, the toner is carried under contact with the elastic blade 7, so that the toner is given appropriate triboelectricity (quantity of triboelectrification) and forms a thin layer on the developing sleeve 5. Then the toner is further conveyed to the developing section being the opposite part to the photosensitive drum 1.

Undeveloped toner not consumed in the developing section is recovered from the bottom part of developing sleeve 5 with rotation thereof. In this recovering section a seal member 19 is provided to let the undeveloped toner pass into the developer container 14 and to prevent the toner 8 in the developer container 14 from leaking through the bottom part of developing sleeve 5.

The undeveloped toner on the developing sleeve 5, thus recovered, is scraped from the surface of developing sleeve 5 in the contact portion between the elastic roller 6 and the developing sleeve 5. Most of toner thus scraped off is conveyed with rotation of the elastic roller 6 to be mixed with the toner 8 in the developer container 14 and the charge on the toner is dispersed. At the same time, new toner is supplied onto the developing sleeve 5 by rotation of the elastic roller 6 and the above-stated action is repeated.

In the above developing section the latent image on the photosensitive drum 1 is developed as a toner image by applying an alternating voltage with direct current being superimposed thereon (a development AC bias) between the developing sleeve 5 and the photosensitive drum 1 by power supply 20.

Next described is a specific example of each constituent element in the developing apparatus 4 in the present embodiment.

The developing sleeve 5 was the one obtained by subjecting a surface of an aluminum sleeve having the diameter of 16 mm to a regular blast treatment with spherical glass beads (#600) before surface roughness Rz thereof became about 3 $\mu$m, and it was disposed as opposed to the photosensitive drum 1 with the gap of 300 $\mu$m and was rotated at the tip speed (peripheral speed) of 80 mm/s a little faster than the tip speed 50 mm/s of the photosensitive drum 1.

The toner 8 was a non-magnetic monocomponent developer, which had a mean particle size of 8 $\mu$m.

The elastic roller 6 is preferably of the sponge structure or of the fur brush structure in which fibers of rayon, nylon, or the like are planted on a core, in terms of supply of toner 8 onto the developing sleeve 5 and scraping of undeveloped toner. The present embodiment employed the elastic roller 6 of the diameter 12 mm in the structure wherein rubber sponge was disposed on a core. This elastic roller 6 was set in contact with the developing sleeve 5 and was driven by a driving means, not illustrated, to rotate in the same direction as the developing sleeve 5 was.

The elastic blade 7 according to the present invention is described in detail below.

The polyamide elastomer is a resultant from ester linkage or amide linkage between polyamide and polyether, as described previously.

The polyamide component is selected from polyamide 6, polyamide 6/6, polyamide 6/12, polyamide 11, polyamide 12, polyamide 12/12; or copolyamides resulting from condensation polymerization of monomers thereof; and a preferred polyamide component may be selected from those obtained by carboxylating terminal amino groups of the foregoing polyamides with a dibasic acid or the like. Examples of the dibasic acid include aliphatic saturated dicarboxylic acids such as oxalic acid, succinic acid, adipic acid, suberic acid, sebacic acid, and dodecanedioic acid; aliphatic unsaturated dicarboxylic acids such as maleic acid; aromatic dicarboxylic acids such as phthalic acid and terephthalic acid; polydicarboxylic acids made of the foregoing dibasic acids and diols such as ethylene glycol, butanediol, hexanediol, and octanediol, and so on.

The polyether component is one selected from polyetherdiols such as homopolymers or copolymers of polyethylene glycol, polypropylene glycol, polytetramethylene glycol, and the like; and polyetherdiamines with the both terminals aminated.

In the present embodiment, the polyamide elastomer was molded as an elastic member 16 in the thickness of 1 mm on the metal thin film 17 of phosphor bronze 0.1 mm thick having the spring elastic property. Specifically, the polyamide elastomer was synthesized by using nylon 12 as the polyamide component, letting nylon 12 react with dodecanedioic acid as the dibasic acid, and using polytetramethylene glycol as the polyether component. The resultant was dried for a predetermined time and thereafter was injected by injection molding directly into the mold with the metal thin film 17 set therein, at the melt temperature 200° C. and at the mold temperature 30° C., thereby fabricating the elastic blade 7.

In order to clarify the proper hardness range of this polyamide elastomer, the present inventors prepared test samples obtained by forming polyamide elastomers of different hardnesses on the metal thin film 17 by the above method. The unit of hardness employed herein was the Shore D hardness (ASTM D2240), normally used for expressing the hardness of resin.

For checking the proper Shore D hardness range, each test sample of elastic blade was set under contact pressure of 20 g in the developing apparatus of the present embodiment, print operations of 3000 sheets were carried out under the high-temperature and high-humidity circumstance (35° C./90% RH), and the test sample was evaluated, especially, by observing fog on image and the toner coating condition on the developing sleeve 5.

In the developing operation the development bias applied from the power supply 20 to the developing sleeve 5 was one obtained by superimposing the DC voltage of −400 V on the alternating voltage of the frequency 2000 Hz and the peak-to-peak voltage 1600 V, so that surface potentials of the latent image on the photosensitive drum 1 were −600 V in unexposed portions and −150 V in exposed portions, thereby performing the reversal development in the exposed portions.

Results of evaluation are shown in the following table.

| Material | Shore D hardness | Fog | Coating unevenness | |
|---|---|---|---|---|
| | | | Initial | After 3000 prints |
| polyamide elastomer | 20 | x | ○ | ○ |
| polyamide elastomer | 25 | ○ | ○ | ○ |
| polyamide elastomer | 40 | ○ | ○ | ○ |
| polyamide elastomer | 55 | ○ | ○ | ○ |
| polyamide elastomer | 65 | ○ | ○ | ○ |
| polyamide elastomer | 70 | ○ | ○ | x |
| polyamide resin | 74 | ○ | x | x |

As apparent from the table, in the case of the Shore D hardness being 20, fog occurred on the image from the initial stage of the print operation, whereas this fog did not appear in the case of the Shore D hardness being 25 or more. The reason is that the polyamide elastomer of low Shore D hardness includes a low content of the polyamide component in the formulation thereof and exhibits the low electron donating property to the negative-polarity toner, as described previously.

The preferred content of the polyamide component is 20% or more by weight with respect to the polyamide elastomer.

In the case of the Shore D hardness being 70, toner coating unevenness and stripe appeared on the developing sleeve 5 after print operations of 3000 sheets. In contrast, no coating unevenness occurred in the case of the Shore D hardness being 65 or less. The cause of this unevenness is the fusion of toner on the surface of elastic blade 7, which is caused by excessive force locally applied on the toner because of too high hardness of polyamide elastomer. The table further shows the evaluation result of the polyamide resin having the Shore D hardness 74 as a comparative example. The comparative example showed some coating unevenness on the developing sleeve 5 from the initial state and repetition of print operations of about 1000 sheets resulted in coating stripes. The reason why the coating unevenness occurred from the initial state as observed is the too high hardness and failure in obtaining a uniform contact nip in the longitudinal direction for lack of rubber elasticity. In addition, appearance of coating stripe after durability test is also due to the extreme fusion of toner caused by the high hardness.

Accordingly, the proper range of the Shore D hardness of the polyamide elastomer is between 25 and 65 both inclusive, whereby the desired triboelectrification capability to the toner can be achieved under high-temperature and high-humidity circumstances and whereby fusion of toner can be prevented from occurring on the blade surface after repetition of print operations. As a result, the uniform toner coating was able to be attained stably from the initial state.

(Embodiment 2)

Figure 3:
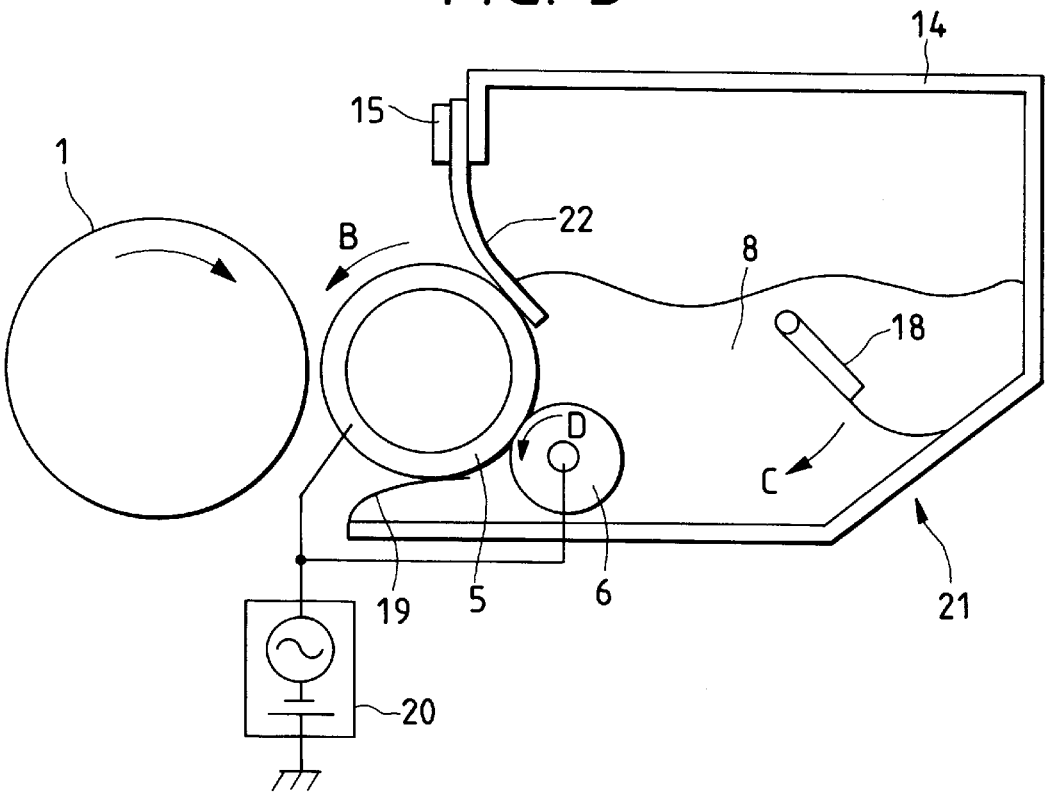
FIG. 3 is a schematic, cross-sectional view of the developing apparatus of Embodiment 2 according to the present invention.
Figure 4:
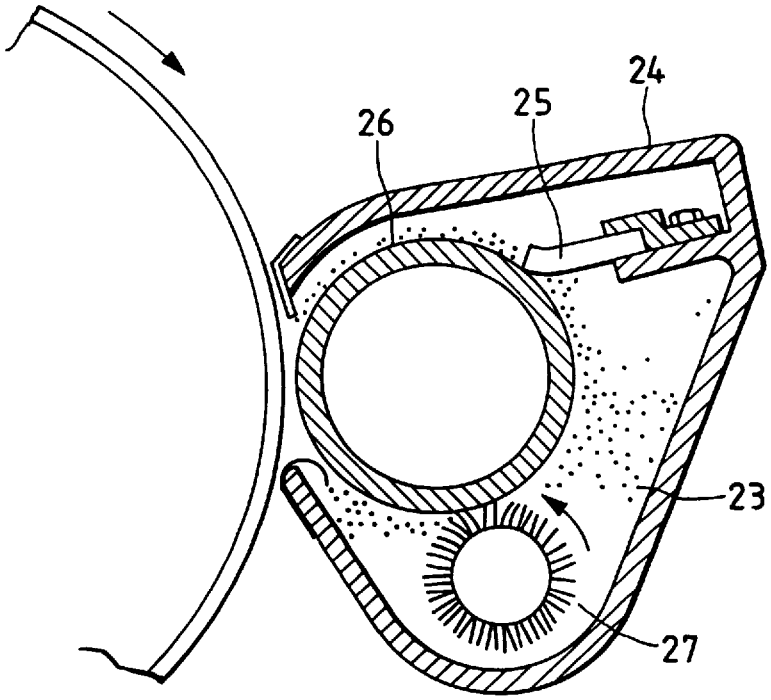
FIG. 4 PRIOR ART
FIG. 4 is a schematic, cross-sectional view of the non-magnetic monocomponent developing apparatus of the conventional example prior to the present invention.

The second embodiment of the present invention will be described referring to FIG. 3 which is the schematic, cross-sectional view of developing apparatus 21.

In the present embodiment, the elastic blade 22 is a plate blade 22 of polyamide elastomer 1.5 mm thick without the metal thin plate 17, different from Embodiment 1.

Namely, the present embodiment is arranged to make the elastic blade 22 in contact with the developing sleeve 5 by the spring elasticity of the polyamide elastomer itself. Since the polyamide elastomer is provided with elasticity based on the polyether component as described in Embodiment 1, the structure can be simplified by omitting the thin metal plate for regulating the pressure, as in the present embodiment.

The proper hardness range of polyamide elastomer is between 25 and 65 both inclusive of Shore D hardness as in Embodiment 1, whereby the same effect as in Embodiment 1 can be achieved.

In this case, the thickness of the blade is preferably not less than 1.0 mm.

It is of course possible to select each of the members used in Embodiments 1 and 2 as the occasion may demand, within the scope of the present invention.

Although Embodiments 1 and 2 employed the process cartridge of the developing apparatus detachably mounted on the main body of image forming apparatus, the developing apparatus may be constructed in such structure that the developing apparatus is fixed in the main body of image forming apparatus and only the toner is replenished thereto. Further, the developing apparatus may be incorporated with the photosensitive drum, cleaning blade, waste toner receiving container, and charging device in the form of a process cartridge to be detachably mounted to the main body of image forming apparatus.

The embodiments of the present invention were described above, but it should be understood that the present invention is by no means limited to these embodiments and that the invention may involve all modifications falling within the technical idea thereof.

What is claimed is:

1. A developer regulating member comprising:

a thin plate having a spring property; and a polyamide-containing rubber layer disposed on said thin plate, and said polyamide-containing rubber layer containing a polyamide having a Shore D hardness between 25 and 65 both inclusive, wherein said polyamide-containing rubber layer frictionally charges a developer to negative polarity.

2. The developer regulating member according to claim 1, wherein the polyamide-containing rubber layer comprises a polyamide component and a polyether component.

3. The developer regulating member according to claim 2, wherein the polyamide-containing rubber layer is a resultant from ester linkage or amide linkage between the polyamide component and the polyether component.

4. A developing apparatus comprising:

a developer container for containing a monocomponent developer of negative charging property;

a developer carrying member provided in an opening portion of said developer container, for carrying the developer; and a regulating member for forming a nip together with said developer carrying member and regulating a thickness of a developer layer on the developer carrying member, wherein a surface of said regulating member forming the nip is comprised of a polyamide-containing rubber layer containing a polyamide having a Shore D hardness between 25 and 65 both inclusive, wherein said polyamide-containing rubber layer frictionally charges a developer to negative polarity.

5. The developing apparatus according to claim 4, wherein the polyamide-containing rubber layer comprises a polyamide component and a polyether component.

6. The developing apparatus according to claim 5, wherein the polyamide-containing rubber layer is a resultant from ester linkage or amide linkage between the polyamide coupling and the polyether coupling.

* * * * *

UNITED STATES PATENT AND TRADEMARK OFFICE

CERTIFICATE OF CORRECTION

PATENT NO. : 5,893,013

DATED : April 6, 1999

INVENTOR(S) : MASAHIDE KINOSHITA, ET AL.

It is certified that error appears in the above-identified patent and that said Letters Patent is hereby corrected as shown below:

COLUMN 1,
Line 12, "method)" should read --method,--; and
Line 64, "a" should be deleted.

COLUMN 2,
Line 50, "metal thin" should read --thin metal--.

COLUMN 4,
Line 67, "obtaining" should read --being obtained--.

COLUMN 5,
Line 1, "metal thin" should read --thin metal--.

COLUMN 7,
Line 63, "metal thin" should read --thin metal--.

Signed and Sealed this

Nineteenth Day of October, 1999

*Attest:*

Q. TODD DICKINSON

*Attesting Officer*

*Acting Commissioner of Patents and Trademarks*